US011339966B2

(12) United States Patent
Bilse et al.

(10) Patent No.: US 11,339,966 B2
(45) Date of Patent: May 24, 2022

(54) FLOW CONTROL WALL FOR HEAT ENGINE

(71) Applicant: General Electric Company, Schenectady, NY (US)

(72) Inventors: Andrew Scott Bilse, Cincinnati, OH (US); Donald Lee Gardner, West Chester, OH (US); Craig Alan Gonyou, Blanchester, OH (US); Paul Christopher Schilling, Waynesville, OH (US); Hojjat Nasr, West Chester, OH (US); Ryan Christopher Jones, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 147 days.

(21) Appl. No.: 16/107,227

(22) Filed: Aug. 21, 2018

(65) Prior Publication Data

US 2020/0063583 A1 Feb. 27, 2020

(51) Int. Cl.

| | |
|---|---|
| ***F23R 3/00*** | (2006.01) |
| ***F23R 3/10*** | (2006.01) |
| ***F23R 3/60*** | (2006.01) |

(52) U.S. Cl.

CPC ..... *F23R 3/002* (2013.01); *F23R 3/10* (2013.01); *F23R 3/60* (2013.01); *F23R 2900/00012* (2013.01); *F23R 2900/03042* (2013.01)

(58) Field of Classification Search

CPC .... F02C 7/28; F23R 2900/00012; F23R 3/16; F23R 3/26; F23R 3/50; F23R 3/44; F23R 3/283; F23R 3/60; F23R 2900/00005; F23R 3/04; F23R 3/10–14; F05D 2230/50–80; F05D 2260/30–311; F05D 2260/36; F05D 2260/38–39; F05D 2260/941

See application file for complete search history.

(56) References Cited

U.S. PATENT DOCUMENTS

| | | | | |
|---|---|---|---|---|
| 4,653,279 A | | 3/1987 | Reynolds | |
| 4,700,544 A | | 10/1987 | Fucci | |
| 4,833,881 A | | 5/1989 | Vdoviak et al. | |
| 5,285,632 A | * | 2/1994 | Halila | F23R 3/34 60/796 |

(Continued)

FOREIGN PATENT DOCUMENTS

| | | | |
|---|---|---|---|
| CN | 107013250 | A | 8/2017 |
| EP | 2660520 | A2 | 11/2013 |

(Continued)

OTHER PUBLICATIONS

Office Action and Search Report issued in corresponding Chinese Application No. 201910769621.9, dated Nov. 3, 2020. (With English language translation).

*Primary Examiner* — Gerald L Sung

(74) *Attorney, Agent, or Firm* — Venable LLP; Elizabeth C. G. Gitlin; Michele V. Frank

(57) ABSTRACT

A combustor assembly for a heat engine is generally provided. The combustor assembly includes a liner wall defining a combustion chamber, and a deflector assembly. The deflector assembly includes a radially extended first wall disposed adjacent to the combustion chamber, and further an axially extended second wall disposed forward of the first wall and adjacent thereto. The second wall is coupled to the liner wall.

6 Claims, 8 Drawing Sheets

(56) References Cited

U.S. PATENT DOCUMENTS

| | | | | |
|---|---|---|---|---|
| 5,682,747 | A * | 11/1997 | Brown | F23R 3/10 60/746 |
| 5,941,076 | A * | 8/1999 | Sandelis | F23R 3/26 60/752 |
| 6,170,266 | B1 | 1/2001 | Pidcock et al. | |
| 6,286,317 | B1 | 9/2001 | Burrus et al. | |
| 6,705,087 | B1 * | 3/2004 | Ohri | F23R 3/14 60/748 |
| 7,047,723 | B2 | 5/2006 | Martling et al. | |
| 7,059,133 | B2 | 6/2006 | Gerendas | |
| 8,307,656 | B2 | 11/2012 | Tuthill | |
| 8,826,668 | B2 | 9/2014 | Lee et al. | |
| 8,893,382 | B2 * | 11/2014 | Patterson | F23R 3/60 29/889.2 |
| 9,010,121 | B2 | 4/2015 | Taylor et al. | |
| 9,534,785 | B2 | 1/2017 | Davenport et al. | |
| 9,976,746 | B2 * | 5/2018 | Bloom | F02C 3/04 |
| 2016/0256957 | A1 | 9/2016 | Ivory et al. | |
| 2016/0377292 | A1 * | 12/2016 | Prociw | F23R 3/283 60/753 |
| 2017/0009986 | A1 * | 1/2017 | Patel | F23R 3/50 |
| 2017/0059167 | A1 * | 3/2017 | Bloom | F23R 3/007 |
| 2017/0074170 | A1 | 3/2017 | Davenport et al. | |
| 2018/0010795 | A1 | 1/2018 | Nath et al. | |
| 2018/0016923 | A1 | 1/2018 | Imfeld et al. | |
| 2018/0128177 | A1 | 5/2018 | Holland et al. | |

FOREIGN PATENT DOCUMENTS

| | | | | |
|---|---|---|---|---|
| EP | 3190340 | A1 | 7/2017 | |
| FR | 2911666 | A1 * | 7/2008 | F23R 3/60 |
| JP | 2002188814 | A | 7/2002 | |
| WO | 2018071074 | A3 | 5/2018 | |

* cited by examiner

FLOW CONTROL WALL FOR HEAT ENGINE

FIELD

The present subject matter relates generally to wall assemblies for heat engines. The present subject matter relates more specifically to wall assemblies for hot sections of heat engines.

BACKGROUND

Combustor assemblies for heat engines such as turbo machines include liners and wall assemblies to define combustion chambers at which fuel and oxidizer are mixed and ignited to produce combustion gases that flow downstream to generate thrust. Combustor assemblies must generally control flows of oxidizer entering, egressing, or flowing around the combustion chamber such as to improve combustion efficiency and performance. As such, there is a need for wall assemblies and sealing devices for combustor assemblies to improve leakage control or flow variation such as to improve combustion efficiency and performance.

BRIEF DESCRIPTION

Aspects and advantages of the invention will be set forth in part in the following description, or may be obvious from the description, or may be learned through practice of the invention.

An aspect of the present disclosure is directed to a combustor assembly for a heat engine. The combustor assembly includes a liner wall defining a combustion chamber, and a deflector assembly including a radially extended first wall disposed adjacent to the combustion chamber. The deflector assembly further includes an axially extended second wall disposed forward of the first wall and adjacent thereto. The second wall is coupled to the liner wall.

In various embodiments, the second wall and the first wall together define a cavity therebetween. In one embodiment, a seal is disposed in the cavity. In another embodiment, the seal is extended 360 degrees through the cavity defining an annulus through the deflector assembly. In yet another embodiment, the second wall includes a radially extended portion adjacent to the first wall. The first wall and the radially extended portion of the second wall together define the cavity. In still yet another embodiment, the first wall includes a portion extended at an acute radial angle. The second wall and the portion of the first wall together define the cavity. In another embodiment, the second wall includes a pair of axially extended portions separated radially by a radially extended portion. The cavity is defined between the first wall and the pair of axially extended portions and the radially extended portion of the second wall.

In one embodiment, the deflector assembly defines an adjustable radial gap between the first wall and the liner wall.

In another embodiment, the second wall and the first wall together define a labyrinth seal assembly.

In still another embodiment, the first wall and the liner wall together define a labyrinth seal assembly.

In various embodiments, the second wall is coupled to the first wall. In one embodiment, the second wall and the first wall are coupled together at an interface. The interface defines an approximately 45 degree joint at the first wall and the second wall. In one embodiment, the second wall defines an opening therethrough in fluid communication with a combustion chamber.

Another aspect of the present disclosure is directed to a heat engine. The heat engine includes a combustion section including a combustor assembly. The combustor assembly includes an inner liner and an outer liner radially spaced apart and defining a combustion chamber therebetween. The combustor assembly further includes a deflector assembly disposed at an upstream end of the liners. The deflector assembly includes a radially extended first wall disposed adjacent to the combustion chamber, and an axially extended second wall disposed forward of the first wall and adjacent thereto. The second wall is coupled to the liners.

In various embodiments, the second wall and the first wall together define a cavity therebetween.

In one embodiment, the cavity defines a substantially serpentine passage.

In another embodiment, the second wall includes a pair of axially extended portions separated radially by a radially extended portion. The cavity is defined between the first wall and the pair of axially extended portions and the radially extended portion of the second wall.

In still another embodiment, the first wall includes a portion extended at an acute radial angle between 15 degrees and 75 degrees relative to a fuel nozzle centerline. The second wall and the portion of the first wall together define the cavity.

In still various embodiments, a seal is disposed in the cavity. In one embodiment, the seal is extended 360 degrees through the cavity defining an annulus through the deflector assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
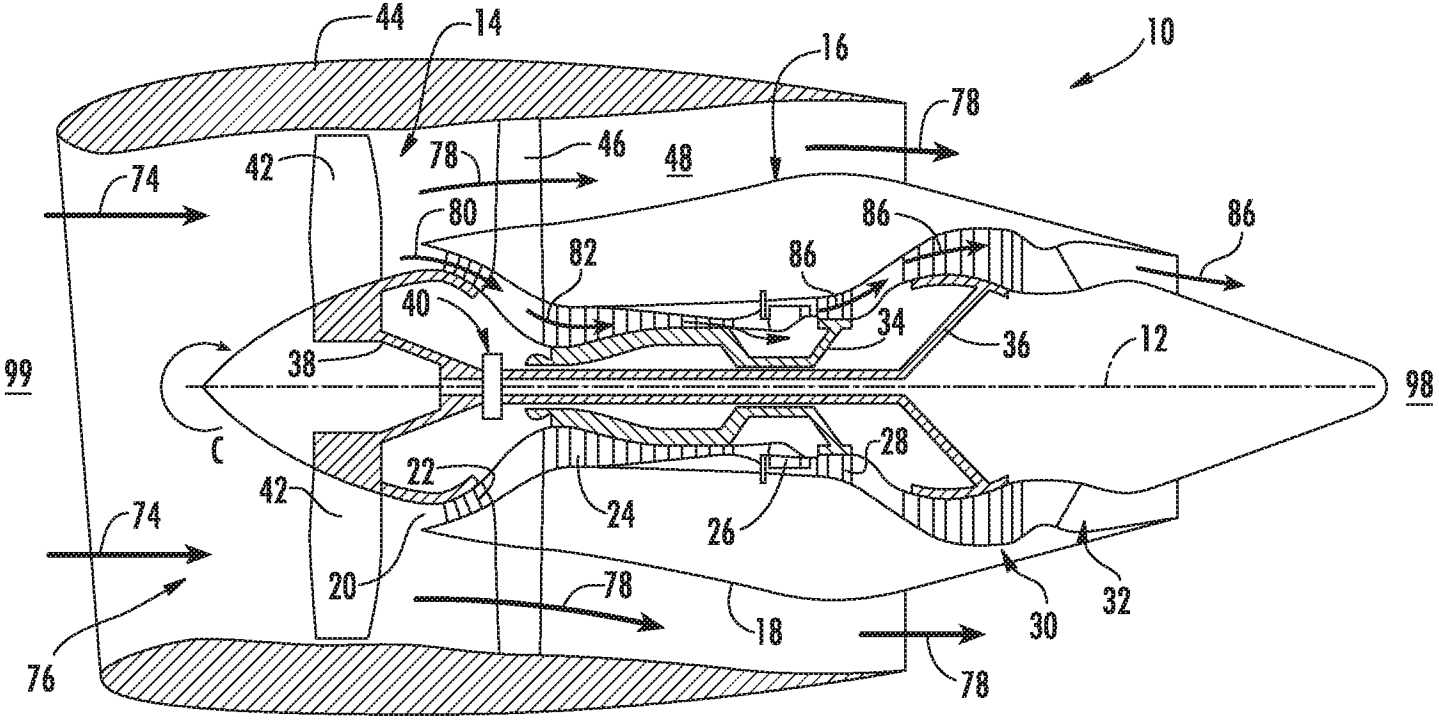
FIG. 1 is a schematic cross sectional side view of an exemplary heat engine according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a heat engine and a combustor assembly are generally provided that may improve leakage control. The various embodiments described herein may limit leakage or flow variation across a deflector assembly into the combustion chamber. Such limitation of leakage or flow variation may improve combustion efficiency, reduce issues regarding combustion emissions or dynamics due to excessive leakage, and generally improve engine efficiency.

Referring now to the drawings, FIG. 1 is a schematic partially cross-sectioned side view of an exemplary high bypass turbofan engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial engine centerline axis 12 that extends there through for reference purposes. The engine 10 defines a longitudinal direction L and an upstream end 99 and a downstream end 98 along the longitudinal direction L. The upstream end 99 generally corresponds to an end of the engine 10 along the longitudinal direction L from which air enters the engine 10 and the downstream end 98 generally corresponds to an end at which air exits the engine 10, generally opposite of the upstream end 99 along the longitudinal direction L. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure compressor and turbine rotatable with an intermediate pressure shaft altogether defining a three-spool gas turbine engine.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
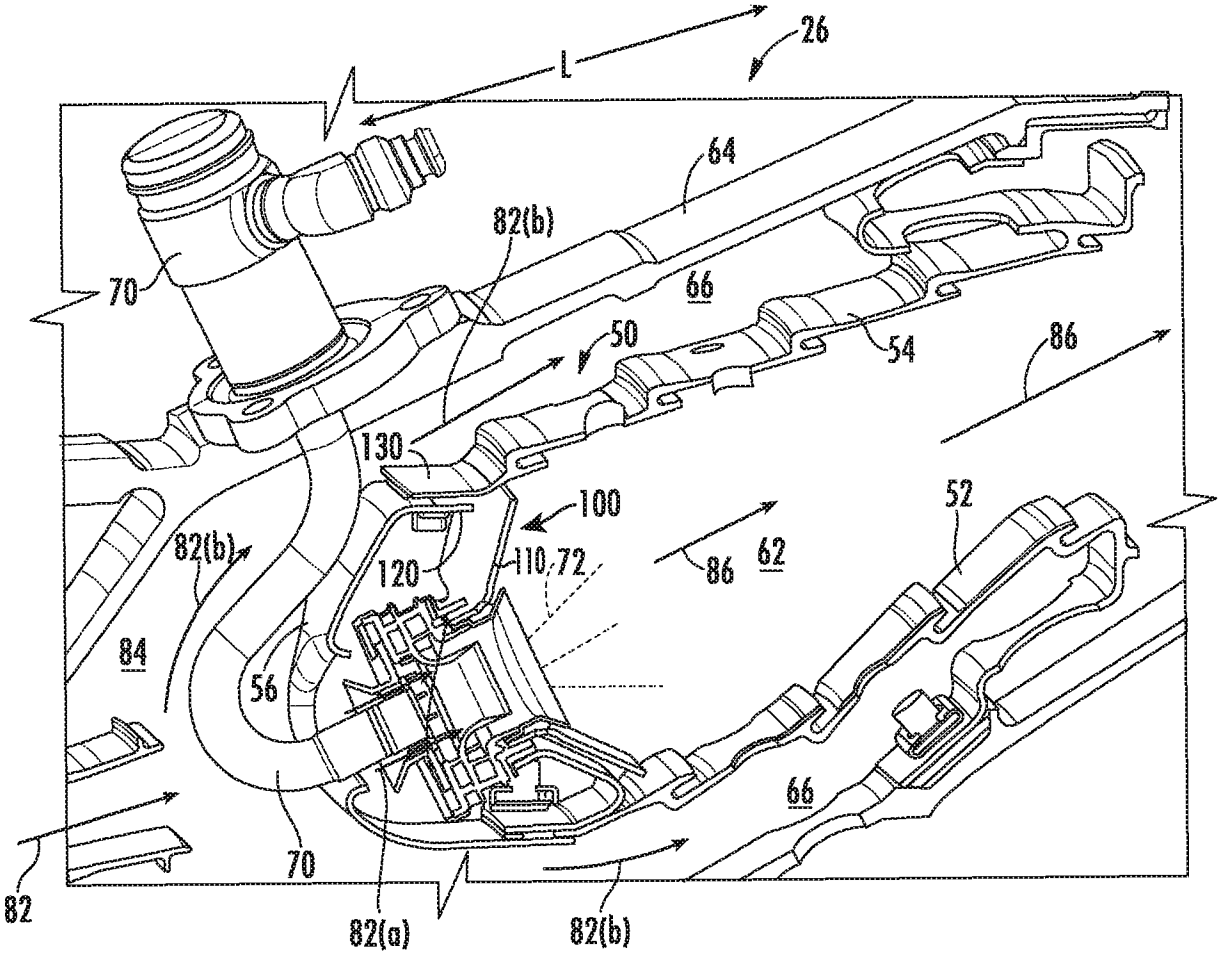
FIG. 2 is a schematic cross sectional side view of an exemplary combustion section of the engine depicted in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends of the inner liner 52 and the outer liner 54 respectively. In other embodiments of the combustion section 26, the combustion assembly 50 may be a can-annular type. The combustor 50 further includes a deflector assembly 100 extended radially between the inner liner 52 and the outer liner 54 downstream of the bulkhead 56. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52, the outer liner 54, and/or the deflector assembly 100 may be at least partially or entirely formed from metal alloys or ceramic matrix composite (CMC) materials.

It should be appreciated that although the exemplary embodiment of the combustor assembly 50 of FIG. 2 depicts an annular combustor, various embodiments of the engine 10 and combustion section 26 may define a can-annular or can combustor configuration.

As shown in FIG. 2, the inner liner 52 and the outer liner 54 may be encased within an outer casing 64. An outer flow passage 66 of a diffuser cavity or pressure plenum 84 may be defined around the inner liner 52 and/or the outer liner 54. The inner liner 52 and the outer liner 54 may extend from the bulkhead 56 towards a turbine nozzle or inlet to the HP turbine 28 (FIG. 1), thus at least partially defining a hot gas path between the combustor assembly 50 and the HP turbine 28. A fuel nozzle 70 may extend at least partially through the bulkhead 56 to provide a fuel 72 to mix with the air 82(*a*) and burn at the combustion chamber 62. In various embodiments, the bulkhead 56 includes a fuel-air mixing structure attached thereto (e.g., a swirler assembly).

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows into a diffuser cavity or pressure plenum 84 of the combustion section 26. The pressure plenum 84 generally surrounds the inner liner 52 and the outer liner 54, and generally upstream of the combustion chamber 62.

The compressed air 82 pressurizes the pressure plenum 84. A first portion of the of the compressed air 82, as indicated schematically by arrows 82(*a*) flows from the pressure plenum 84 into the combustion chamber 62 where it is mixed with the fuel 72 and burned, thus generating combustion gases, as indicated schematically by arrows 86, within the combustor 50. Typically, the LP and HP compressors 22, 24 provide more compressed air to the pressure plenum 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the outer flow passage 66 to provide cooling to the inner and outer liners 52, 54.

Figure 3:
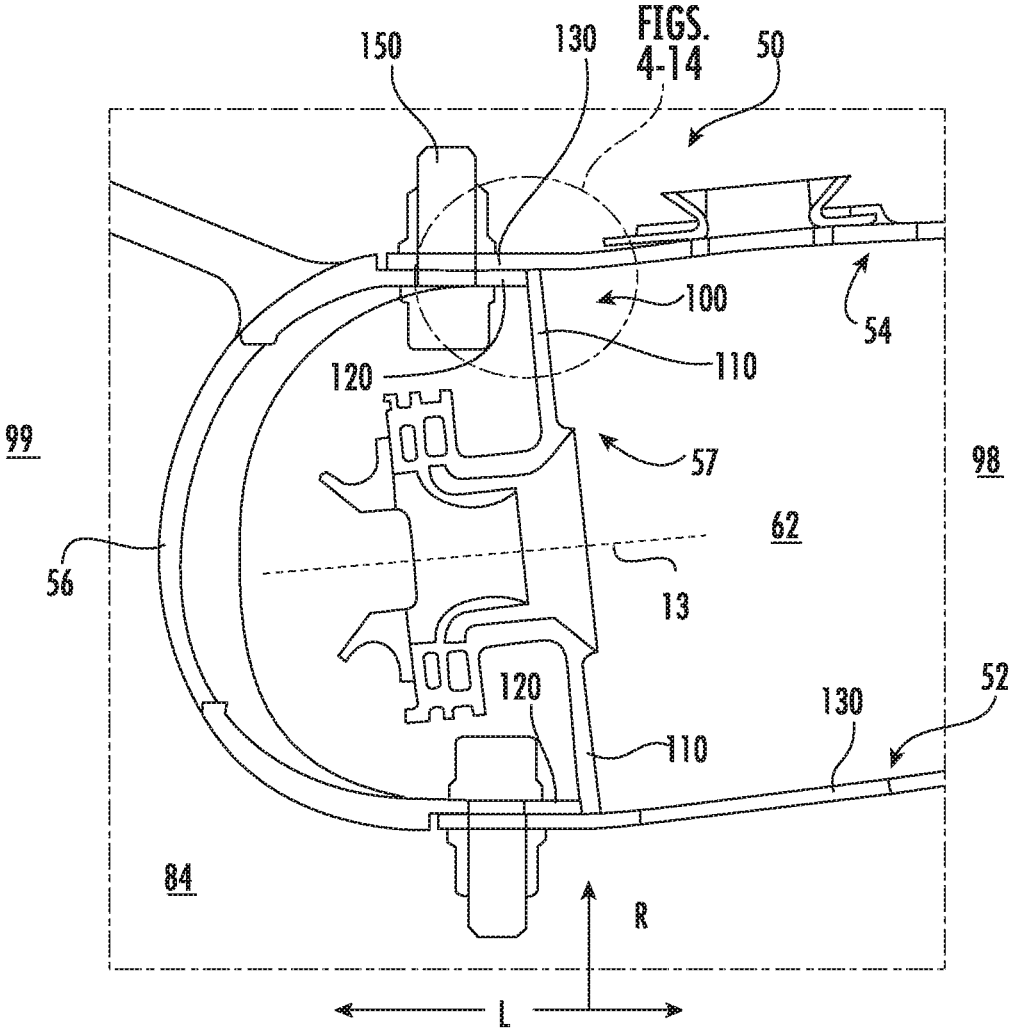
FIG. 3 is an exemplary cross sectional side view of an embodiment of a portion of a combustor assembly of the combustion section depicted in FIG. 2.

Referring to FIG. 3, a cross sectional view of an exemplary embodiment of a portion of the combustor assembly 50 is generally provided. A fuel nozzle centerline 13 is extended substantially along the longitudinal direction L. The combustor assembly 50 includes a first wall 110 extended along a radial direction R and a second wall 120 extended substantially along an axial direction A. In various embodiments, the first wall 110 defines the radially extended wall or deflector wall 57 (FIG. 3) of the deflector assembly 100 adjacent to the combustion chamber 62. In one embodiment, the second wall 120 defines an axially extended wall of the dome assembly 56. In another embodiment, a liner wall 130 defining the combustion chamber 62 radially therewithin is the inner liner 52, the outer liner 54, or both. It should be appreciated that in various embodiments the liner wall 130 may define a liner of a combustor can. For example, the liner wall may extend circumferentially substantially cylindrically around the deflector assembly 100.

Referring still to FIG. 3, the liner wall 130 and the second wall 120 are coupled together. As depicted in regard to FIG. 3, the liner wall 130 and the second wall 120 may be coupled in radially adjacent or stacked arrangement. The liner wall 130 and the second wall 120 may be coupled together via one or more fastening or bonding methods or processes. For example, such as depicted in regard to FIG. 3, the liner wall 130 and the second wall 120 may be coupled together via a mechanical fastener 150 extended through each wall 120, 130. The mechanical fastener 150 may define combinations of bolt and nut, screw, tie rod, etc. However, in other embodiments, the walls 120, 130 may be coupled together via a bonding process, such as, but not limited to, welding, brazing, adhesive, etc. In still various embodiments, the liner wall 130 and the second wall 120 are attached or coupled directly together.

Referring now to FIGS. 4-11, exemplary schematic embodiments of a portion of the combustor assembly 50 of FIG. 3 are generally provided. In various embodiments, the second wall 120 is disposed forward (e.g., toward the forward end 99) of the first wall 110 and adjacent to the first wall 110.

Figure 4:
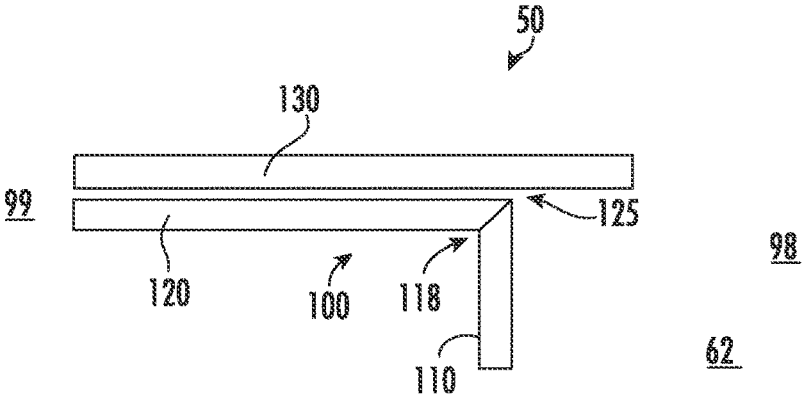
FIGS. 4-14 depict embodiments of a portion of the combustor assembly of FIGS. 2-3.

In various embodiments, the second wall 120 is selectively coupled to the first wall 110. During operation of the engine 10, the second wall 120 and/or the first wall 110 may expand or contract from contact with one another based on an operating condition of the engine 10 (e.g., a pressure, temperature, or flow rate of air through the engine 10). An interface 118 at which the second wall 120 and the first wall 110 contact may generally be defined at an aft end of the second wall 120 (e.g., toward aft end 98). The interface 118 is further generally defined at a radially outward end of the first wall 110. The interface 118 may further include the first wall 110 and the second wall 120 proximate or close to the liner wall 130. In one embodiment, such as generally depicted in FIG. 4, the interface 118 defines an approximately 45 degree joint at the first wall 110 and the second wall 120.

During operation of the engine 10, the interface 118 may expand or contract such as to separate and contact together the first wall 110 and the second wall 120 from the interface 118. For example, the second wall 120 may expand toward the first wall 110 at the interface 118 as the operating condition changes, such as the temperature and/or pressure of the flow of fluid 82 (FIG. 1) increasing (e.g., with increased rotational speed of the HP shaft 34 and/or LP shaft 36). As another example, the second wall 120 may contract from the first wall 110 from the interface 118 as the operating condition changes, such as the temperature and/or pressure of the flow of fluid 82 (FIG. 1) decreasing corresponding to a decrease in rotational speed at the engine 10.

Figure 5:
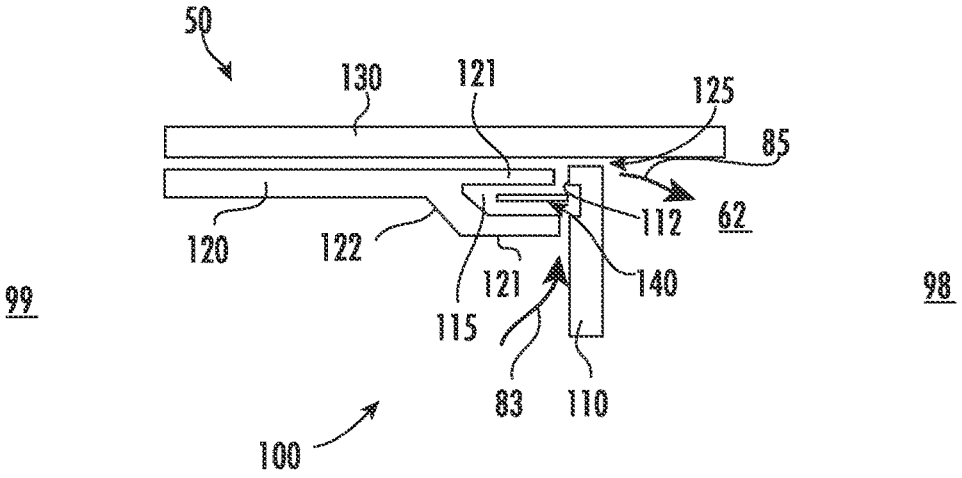
Figure 6:
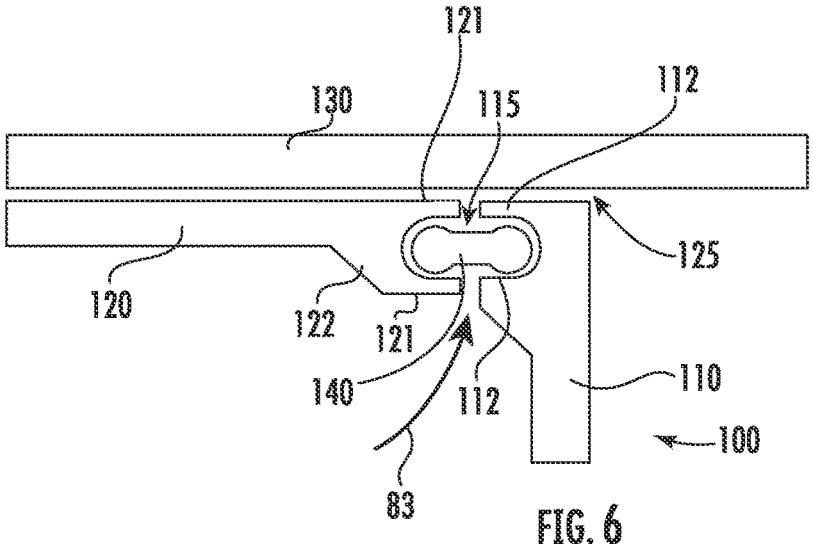
Figure 7:
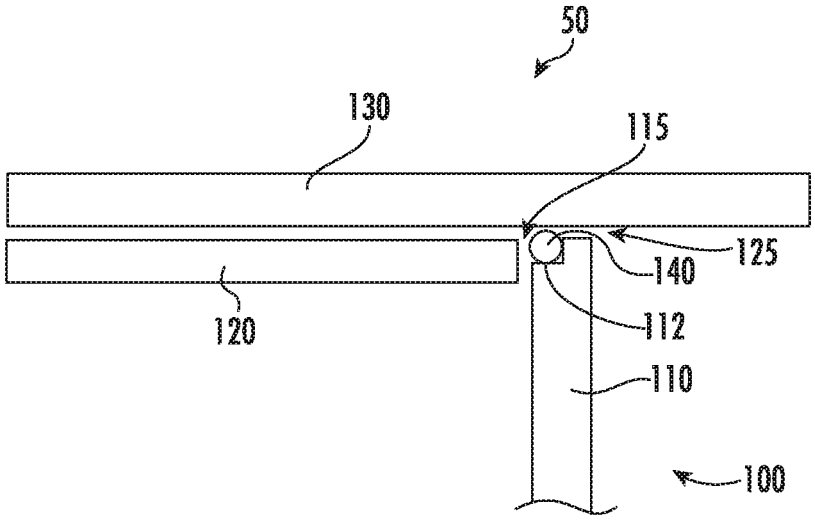

Referring now to FIGS. 5-7, additional exemplary embodiments of the portion of the combustor assembly 50 are generally provided. In various embodiments, the second wall 120 and the first wall 110 may together define a cavity 115 therebetween. In still various embodiments, a seal 140 may be disposed in the cavity 115. In one embodiment, the seal 140 is extended substantially 360 degrees through the cavity 115. In other embodiments, the seal 140 may include a plurality of seals or pieces thereof connected to extend substantially 360 degrees through the cavity 115. For example, the cavity 115 may define an annulus through the deflector assembly 100, such as relative to the combustor centerline 13.

The cavity 115 and seal 140 may together substantially control or prevent a flow of fluid through the cavity 115 to the combustion chamber 62, such as to improve leakage control and improve combustion performance.

Referring still to FIGS. 4-11, the deflector assembly 100 may generally define an adjustable radial gap 125 by which the first wall 110 may generally be separated from the liner wall 130. The radial gap 125 may be substantially controlled by the flow of fluid permitted therethrough via the cavity 115 based on changes in the operating condition such as described above.

In various embodiments the second wall 120 includes a radially extended portion 122. Referring to FIGS. 5-6, in various embodiments, the second wall 120 may further include a pair of axially extended portions 121 separated radially by the radially extended portion 122. The cavity 115 may generally be defined between the first wall 110 and the pair of axially extended portions 121 and the radially extended portion 122 of the second wall 120.

In still various embodiments, the first wall 110 includes a portion 112 extended at least partially along the axial direction A. In one embodiment, such as depicted in regard to FIGS. 5-7, the portion 112 is extended substantially along the axial direction A and further defines the cavity 115 with the second wall 120. In still various embodiments, the portion 112 of the first wall 110, the radially extended portion 122 of the second wall 120, and the axial portions 121 of the second wall 120 together define the cavity 115. In various embodiments, such as further depicted in regard to FIG. 6, the seal 140 is disposed into the second wall 120 and the first wall 110 together defining the cavity 115.

Figure 8:
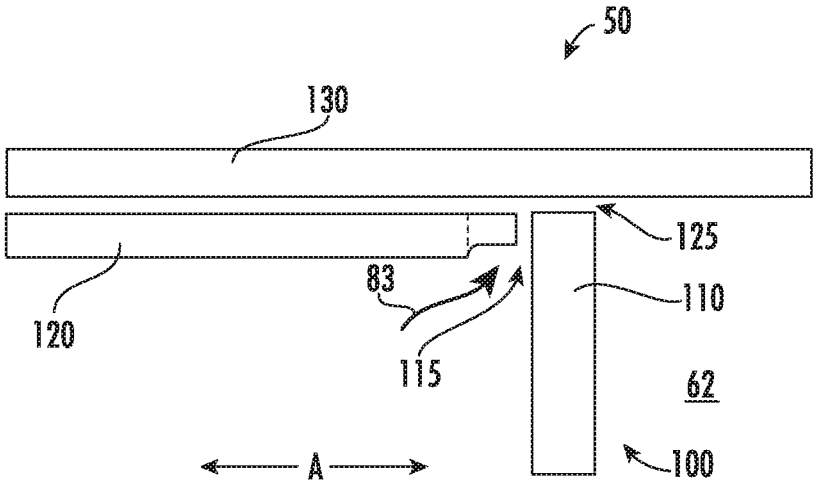
Figure 9:
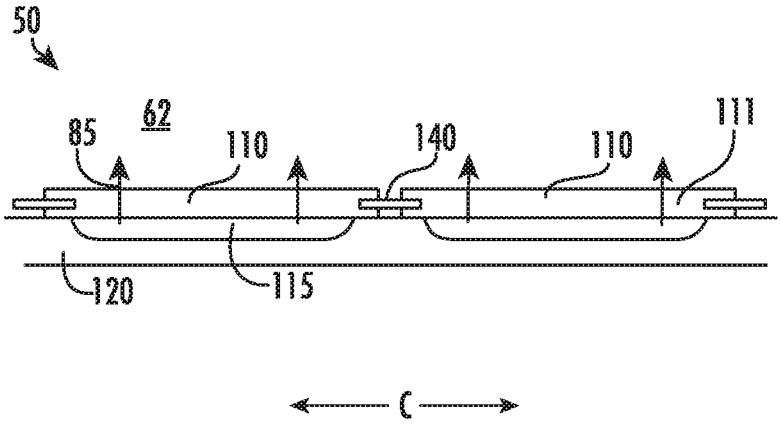

Referring now to FIGS. 8-9, additional exemplary embodiments of portions of the combustor assembly 50 are further provided. FIG. 8 provides an side view such as shown and described in regard to FIGS. 4-7. FIG. 9 provides an exemplary top-down view of the side view generally provided in regard to FIG. 8. In FIG. 9, the deflector assembly 100 may generally include a plurality of first walls 110 arranged in adjacent arrangement around an annulus of the combustor assembly 50. The seal 140 may be disposed between circumferentially adjacent (i.e., adjacent along circumferential direction C in FIG. 9) portions of the first wall 110.

Referring to FIG. 9, the first wall 110 of the deflector assembly 100 may further define an opening 111 therethrough. The opening 111 may generally define a cooling orifice or shaped opening to permit a flow of air, shown via arrows 85, to egress from the cavity 115 to the combustion chamber 62. The opening 111 may generally provide thermal attenuation or cooling to the first wall 110 of the deflector assembly 100.

Figure 10:
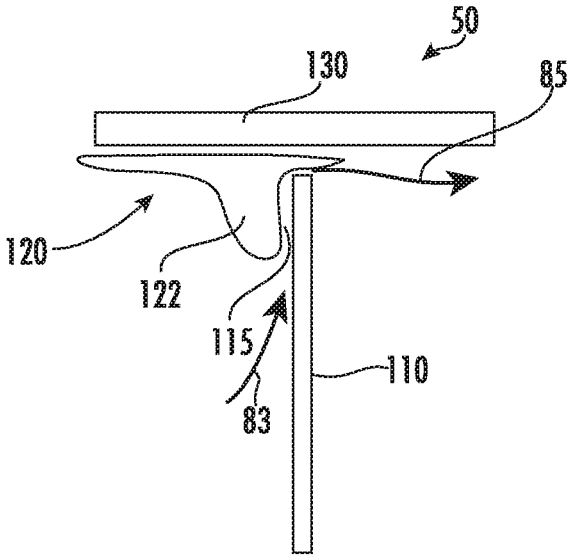
Figure 11:
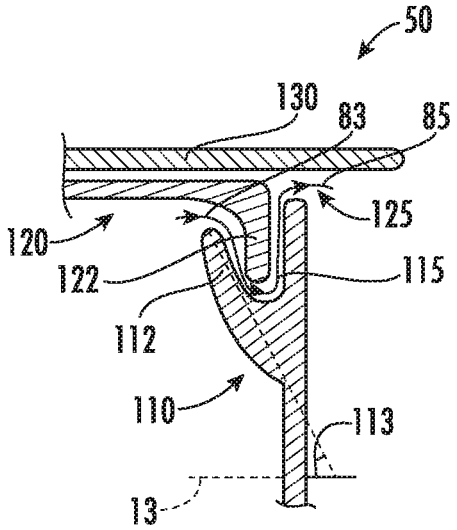

Referring now to FIGS. 10-11, additional exemplary embodiments of portions of the combustor assembly 50 are further provided. The radially extended portion 122 of the second wall 120 is extended substantially along the radial direction R adjacent to the first wall 110. The first wall 110 and the radially extended portion 122 of the second wall 120 may together define the cavity 115 therebetween.

Referring to FIG. 11, in one exemplary embodiment, the portion 112 of the first wall 110 may extend at an acute radial angle 113 relative to the longitudinal direction L. In various embodiments, the acute radial angle 113 may be between approximately 15 degrees and approximately 75 degrees relative to the fuel nozzle centerline 13. In one embodiment, the acute radial angle 113 may be between approximately 30 degrees and approximately 60 degrees relative to the fuel nozzle centerline 13.

Referring still to FIG. 11, the second wall 120 and the portion 112 of the first wall 110 may together define the cavity 115 therebetween. In various embodiments, the radially extended portion 122 of the second wall 120 and the portion 112 of the first wall 110 may together define the cavity 115 therebetween.

In still various embodiments, such as generally depicted in FIGS. 10-11, the second wall 120 and the first wall 110 may define the cavity 115 as a substantially serpentine passage. The cavity 115 defining the substantially serpentine passage may generally define one or more pinch points, flow turns, or other features inhibiting an amount of the flow of fluid 83 through the cavity 115 to flow to the combustion chamber 62, such as generally depicted via arrows 85.

Figure 12:
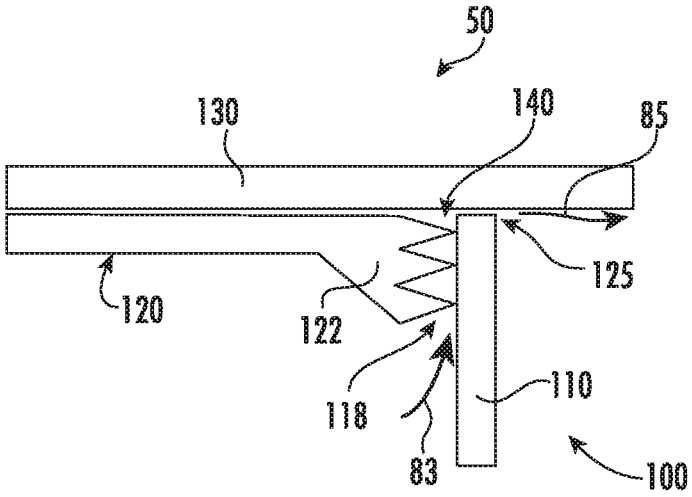
Figure 13:
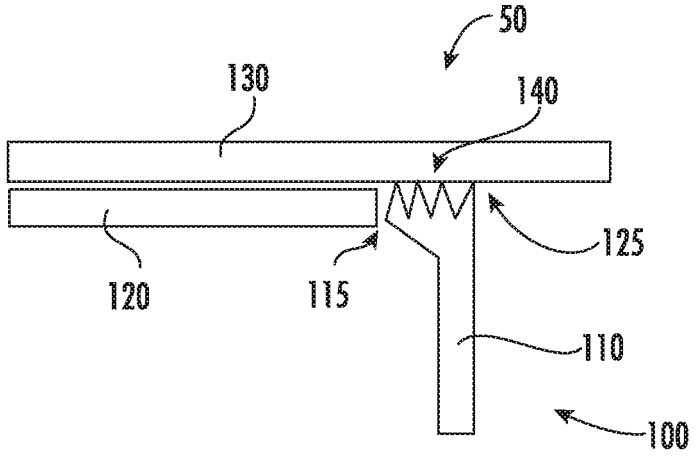

Referring now to FIGS. 12-13, further exemplary embodiments of a portion of the combustor assembly 50 are generally provided. The embodiments shown in regard to FIGS. 12-13 may be configured substantially similarly as shown and described in regard to FIGS. 4-11. However, in FIGS. 12-13, the combustor assembly 50 may further define the seal 140 as a labyrinth seal assembly. In one embodiment, such as depicted in regard to FIG. 12, the second wall 120 and the first wall 110 may together define the seal 140 as the labyrinth seal assembly. In another embodiment, such as depicted in regard to FIG. 13, the first wall 110 and the liner wall 130 may together define the seal 140 as the labyrinth seal assembly. Referring to FIGS. 12-13, the seal 140

Figure 14:
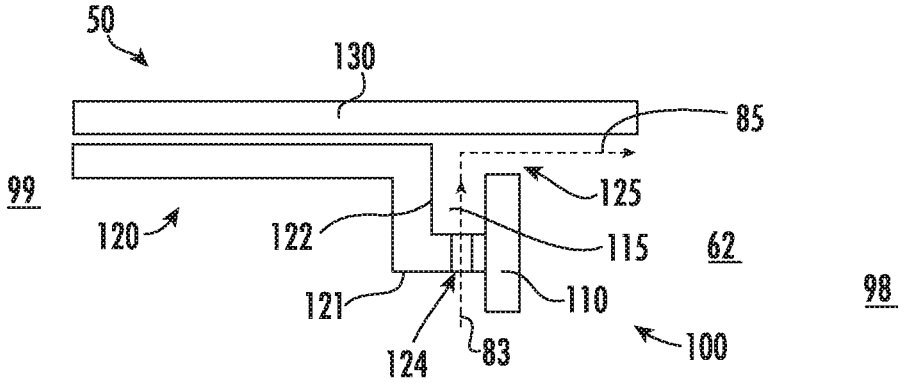

Referring now to FIG. 14, another exemplary embodiment of a portion of the combustor assembly 50 is generally provided. The embodiment shown in regard to FIG. 14 may be configured substantially similarly as shown and described in regard to FIGS. 4-13. Regarding FIG. 14, in one embodiment, the second wall 120 may further define an opening 124 therethrough to permit a flow of fluid 83 therethrough to the cavity 115. In various embodiments, the opening 124 may generally define a metering hole or orifice to control an amount of the flow of fluid 83 permitted therethrough and to the combustion chamber 62, such as depicted via arrows 85.

All or part of the combustor assembly 50 may be part of a single, unitary component and may be manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or any combination thereof may be utilized to construct the combustor 50, including, but not limited to, the first wall 110, the second wall 120, the liner 130, the seal 140, or combinations thereof. Furthermore, the combustor assembly may constitute one or more individual components that are mechanically joined (e.g. by use of bolts, nuts, rivets, or screws, or welding or brazing processes, or combinations thereof) or are positioned in space to achieve a substantially similar geometric, aerodynamic, or thermodynamic results as if manufactured or assembled as one or more components. Non-limiting examples of suitable materials include high-strength steels, nickel and cobalt-based alloys, and/or metal or ceramic matrix composites, or combinations thereof.

Embodiments of the engine 10 and combustor assembly 50 generally shown and described herein may improve leakage control. The various embodiments described herein may limit leakage or flow variation across the deflector assembly 100 into the combustion chamber 62. Such limitation of leakage or flow variation may improve combustion efficiency, reduce issues regarding combustion emissions or dynamics due to excessive leakage, and generally improve engine efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a heat engine, the combustor assembly comprising:

a liner wall defining a combustion chamber;

a fuel nozzle extending through a deflector assembly into the combustion chamber, the fuel nozzle defining a centerline;

the deflector assembly comprising:

a radially extended first wall disposed adjacent to the combustion chamber;

an axially extended second wall disposed forward of the radially extended first wall of the deflector assembly and adjacent thereto, the axially extended second wall comprising a first axially extended portion separated radially from a second axially extended portion of the axially extended second wall by a radially extended portion of the axially extended second wall, wherein the first axially extended portion has a radially outer surface with respect to the centerline and the second axially extended portion has a radially inner surface with respect to the centerline;

a cavity defined by the radially extended first wall, the radially outer surface of the first axially extended portion, the radially inner surface of the second axially extended portion, and the radially extended portion; and a seal disposed in the cavity, wherein the first axially extended portion provides a radially innermost surface of the axially extended second wall and has a constant cross-section from the radially extended portion to a terminal end of the first axially extended portion.

2. The combustor assembly of claim 1, wherein the seal is extended 360 degrees through the cavity defining an annulus through the deflector assembly.

3. The combustor assembly of claim 1, wherein the deflector assembly defines an adjustable radial gap between the radially extended first wall and the liner wall.

4. The combustor assembly of claim 1, wherein the axially extended second wall is coupled to the radially extended first wall.

5. A heat engine, the heat engine comprising:

a combustion section comprising a combustor assembly and a fuel nozzle having a centerline, wherein the combustor assembly comprises an inner liner and an outer liner radially spaced apart from the inner liner to define a combustion chamber therebetween, and the combustor assembly further comprising a deflector assembly disposed at an upstream end of both the inner liner and the outer liner, the deflector assembly comprising:

a radially extended first wall disposed adjacent to the combustion chamber, and an axially extended second wall disposed forward of the radially extended first wall and adjacent thereto, wherein the axially extended second wall is coupled to both the inner liner and the outer liner, and wherein the axially extended second wall comprises a first axially extended portion separated radially from a second axially extended portion of the axially extended second wall by a radially extended portion of the axially extended second well the first axially extended portion having a radially outer surface with respect to the centerline and the second axially extended portion having a radially inner surface with respect to the centerline, wherein a cavity is defined by the radially extended first wall, the radially outer surface of the first axially extended portion, the radially inner surface of the second axially extended portion, and the radially extended portion, wherein a seal is disposed in the cavity, and wherein the first axially extended portion provides a radially innermost surface of the axially extended second wall and has a constant cross-section from the radially extended portion to a terminal end of the first axially extended portion.

6. The heat engine of claim 5, wherein the seal is extended 360 degrees through the cavity defining an annulus through the deflector assembly.

* * * * *